US007016128B2

(12) United States Patent
Westra et al.

(10) Patent No.: US 7,016,128 B2
(45) Date of Patent: Mar. 21, 2006

(54) METHOD OF MAKING A HIGH REFLECTIVITY MICRO MIRROR AND A MICRO MIRROR

(76) Inventors: Kenneth Lloyd Westra, #1201, 9837 - 110 Street, Edmonton, Alberta (CA) T5K 2L8; Brian Moore, 234 Ockenden Pl., Edmonton, Alberta (CA) T6R 1K6

( * ) Notice: Subject to any disclaimer, the term of this patent is extended or adjusted under 35 U.S.C. 154(b) by 0 days.

(21) Appl. No.: 10/932,189

(22) Filed: Sep. 1, 2004

(65) Prior Publication Data

US 2005/0032377 A1 Feb. 10, 2005

Related U.S. Application Data

(62) Division of application No. 09/758,715, filed on Jan. 11, 2001, now abandoned.

(30) Foreign Application Priority Data

Aug. 1, 2000 (CA) ..... 2,314,783

(51) Int. Cl.
*G02B 7/02* (2006.01)

(52) U.S. Cl. ..... 359/819; 359/822; 359/813

(58) Field of Classification Search ..... 359/819, 359/822, 823, 824, 813, 811
See application file for complete search history.

(56) References Cited

U.S. PATENT DOCUMENTS

| | | | | |
|---|---|---|---|---|
| 4,317,611 | A | 3/1982 | Petersen | 359/214 |
| 4,854,658 | A | 8/1989 | Stanley | 385/18 |
| 5,024,500 | A | 6/1991 | Stanley et al. | 385/16 |
| 5,087,124 | A | 2/1992 | Smith et al. | 356/482 |
| 5,303,256 | A | 4/1994 | Sumida | 372/106 |
| 5,629,790 | A | 5/1997 | Neukermans et al. | 359/198 |
| 5,701,326 | A | 12/1997 | Flowers | 372/99 |
| 5,719,073 | A | 2/1998 | Shaw et al. | 438/53 |
| 5,847,871 | A | 12/1998 | Sumida et al. | 359/487 |
| 5,909,280 | A | 6/1999 | Zavracky | 356/454 |
| 5,968,264 | A | 10/1999 | Iida et al. | 117/30 |
| 6,008,128 | A | 12/1999 | Habuka et al. | 438/695 |
| 6,014,240 | A | 1/2000 | Floyd et al. | 359/201 |
| 6,035,079 | A | 3/2000 | Fields et al. | 385/19 |
| 6,044,705 | A | 4/2000 | Neukermans et al. | 73/504.02 |
| 6,108,121 | A | 8/2000 | Mansell et al. | 359/291 |
| 6,112,001 | A | 8/2000 | Kishida et al. | 438/39 |
| 6,121,068 | A | 9/2000 | Ramdani et al. | 438/39 |
| 2003/0091290 | A1 | 5/2003 | Whitehead | 385/50 |

OTHER PUBLICATIONS

Madou, Marc, "Fundamentals of Microfabrication", CRC Press, Washington, DC., 1997, pp. 148-154.

*Primary Examiner*—Timothy Thompson
(74) *Attorney, Agent, or Firm*—Davis & Bujold P.L.L.C.

(57) ABSTRACT

A method of making a high reflectivity micro mirror. A first step involves providing a monolithic bulk crystal silicon having an anisotropic body with a crystalline plane. A second step involves applying chemical agents to selectively remove a portion of the body overlying the crystalline plane to expose a portion of the crystalline plane. Crystalline planes that are present in monolithic bulk crystal silicon have an inherent smoothness which is on an atomic level. The underlying teaching of the present invention is that, instead of attempting to polish or otherwise smooth the surface of the silicon, one should merely expose all or a selected portion of the crystalline plane and use the exposed portion of the crystalline plane as a mirror surface.

18 Claims, 12 Drawing Sheets

METHOD OF MAKING A HIGH REFLECTIVITY MICRO MIRROR AND A MICRO MIRROR

This application is a divisional of U.S. application Ser. No. 09/758,715 filed on Jan. 11, 2001 now abandoned which claims priority from Canadian patent application serial no. 2,314,783 filed on Aug. 1, 2000.

FIELD OF THE INVENTION

The present invention relates to a method of making a high reflectivity micro mirror and a high reflectivity micro mirror fabricated in accordance with the teachings of the method.

BACKGROUND OF THE INVENTION

High reflectivity micro mirrors are used in optical telecom systems, optical scanners, scientific instrumentation and other applications. These mirrors are used as: 1) scanners which scan an optical beam in a desired pattern, 2) servos which allow the position of an optical light beam to be actively adjusted to maintain optimal positioning on a target, such as an optical fibre or a detector 3) switches which allow optical beams to be switched from one position to another.

At the present time cylindrical crystalline structures of silicon are formed which are referred to as "boules". These boules are cut into thin membrane silicon wafers which are micromachined until they have a highly reflective surface. U.S. Pat. No. 6,008,128 (Habuka et al) discusses the science involved in smoothing a surface of a silicon wafer until it has a highly reflective surface.

Thin membrane silicon wafers are fragile, temperature sensitive and prone to distortion due to internal stresses which makes the smoothing process more difficult.

SUMMARY OF THE INVENTION

The present invention relates to an alternative method of making a high reflectivity micro mirror and a high reflectivity micro mirror fabricated in accordance with the teachings of that method.

According to one aspect of the present invention there is provided a method of making a high reflectivity micro mirror. A first step involves providing a monolithic bulk crystal silicon having an anisotropic body with a crystalline plane. A second step involves applying chemical agents to selectively remove a portion of the body overlying the crystalline plane to expose a portion of the crystalline plane, such that a mirror surface is formed which is co-extensive with the exposed portion of the crystalline plane.

According to another aspect of the invention there is provided a high reflectivity micro mirror which includes a monolithic bulk crystal silicon having an anisotropic body with a crystalline plane. The body has a mirror surface co-extensive with a selectively exposed portion of the crystalline plane.

Crystalline planes that are present in monolithic bulk crystal silicon have an inherent smoothness which is on an atomic level. The underlying teaching of the present invention is that, instead of attempting to polish or otherwise smooth the surface of the silicon, one should merely expose all or a selected portion of the crystalline plane and use the exposed portion of the crystalline plane as a mirror surface.

Once this basic teaching is understood a number of other innovations become possible, as will hereafter be further described.

It will be appreciated that a crystalline plane can be exposed to such an extent that it becomes part of an exterior surface of the body or access can be provided to a crystalline plane that remains positioned internally within the body. There are various ways to provide access to an internally positioned crystalline plane, for example an inlet passage and an outlet passage can be provided which intersect at the crystalline plane.

Alignment of reflective elements has long been a problem in the industry. Alignment with atomic accuracy can be obtained by selectively exposing several discrete portions of the crystalline plane. This creates several discrete mirror surfaces along crystalline plane. For example, one can create parallel passages extending along the crystalline plane, intersecting passages extending along the crystalline plane, or several discrete mirror surfaces axially aligned and spaced along the crystalline plane.

The standard in the industry is to work with monolithic bulk crystal silicon cut into wafers. It will be appreciated, however, that the monolithic bulk crystal silicon need not be in wafer form. A larger monolithic bulk crystal silicon will have several, if not multiple, crystalline planes. Complex structures can be developed by selectively removing a portion of the body overlying selected ones of the several crystalline planes. This creates a complex structure with several mirror surfaces that have a relationship with each other that has atomic accuracy.

In order to accurately align reflective elements, there is a need for the mirror surface of a wafer to be at a selected angle. The angle required is now achieved by micro machining. With the present invention, it is possible to obtain a crystalline plane in any desired orientation merely by selectively cutting the wafers from a larger monolithic bulk crystal silicon at angles to ensure the crystalline plane of the wafers have an orientation consistent with an intended application.

In some applications a larger mirror surface or a mirror surface of an unusual shape is required. While there will not be an unusual shaped crystalline plane that will match the unusual shape of mirror surface required, the same effect can be obtained by stacking two or more wafers. The stacked wafers provide a composite mirror surface consisting of the combined mirror surfaces of two or more stacked wafers.

Although beneficial results may be obtained through the use of the high reflectivity mirror, as described above, even more beneficial results may be obtained when means is provided for selectively adjusting the position or angle of the mirror surface by manipulating the position of the body.

The invention also makes possible a number of innovated switching devices which will hereinafter be illustrated and described.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1A:
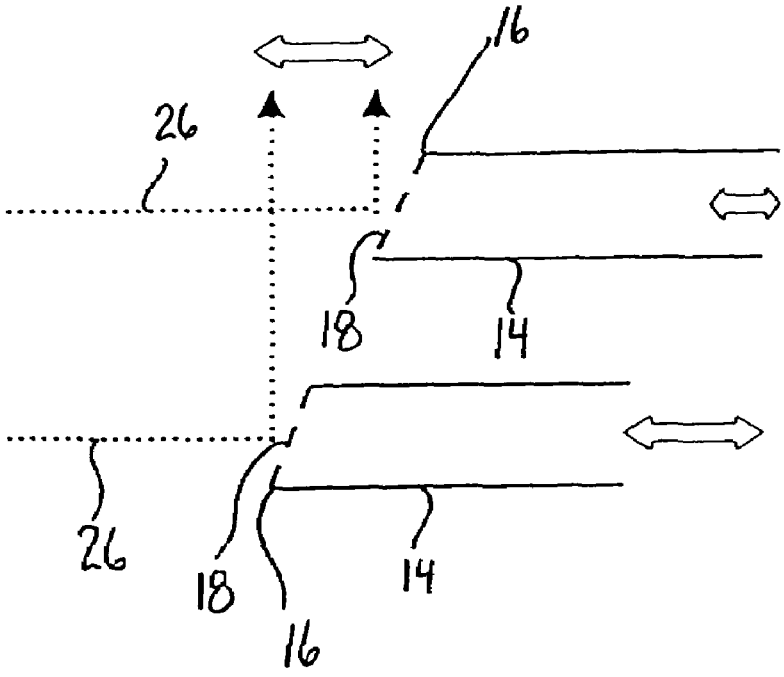
FIG. 1*a* is a side elevation view of a high reflectivity micro mirror fabricated in accordance with the teachings of the present invention, with positional adjustment.

The preferred embodiment, a high reflectivity micro mirror generally identified by reference numeral 10, will now be described with reference to FIGS. 1*a* through 21.

Figure 4A:
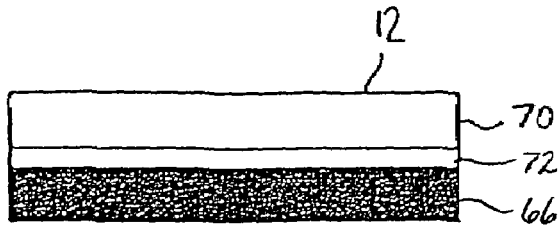
FIG. 4*a* is a side elevation view, in section, showing a first step in fabricating the high reflectivity micro mirror illustrated in FIG. 1.
Figure 4B:
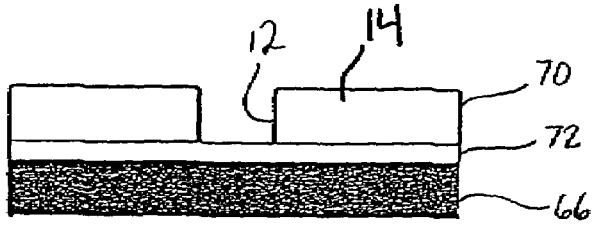
FIG. 4*b* is a side elevation view, in section, showing a second step in fabricating the high reflectivity micro mirror illustrated in FIG. 1.
Figure 4C:
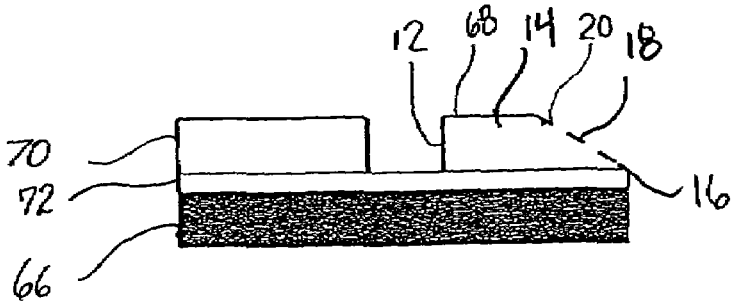
FIG. 4*c* is a side elevation view, in section, showing a third step in fabricating the high reflectivity micro mirror illustrated in FIG. 1.
Figure 4D:
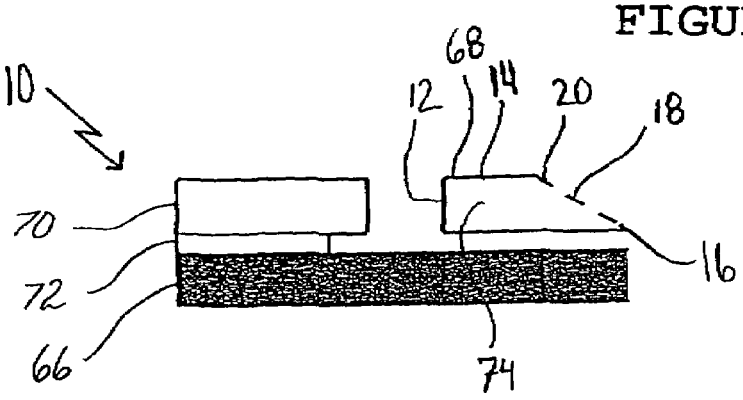
FIG. 4*d* is a side elevation view, in section, showing a fourth step in fabricating the high reflectivity micro mirror illustrated in FIG. 1.
Figure 21:
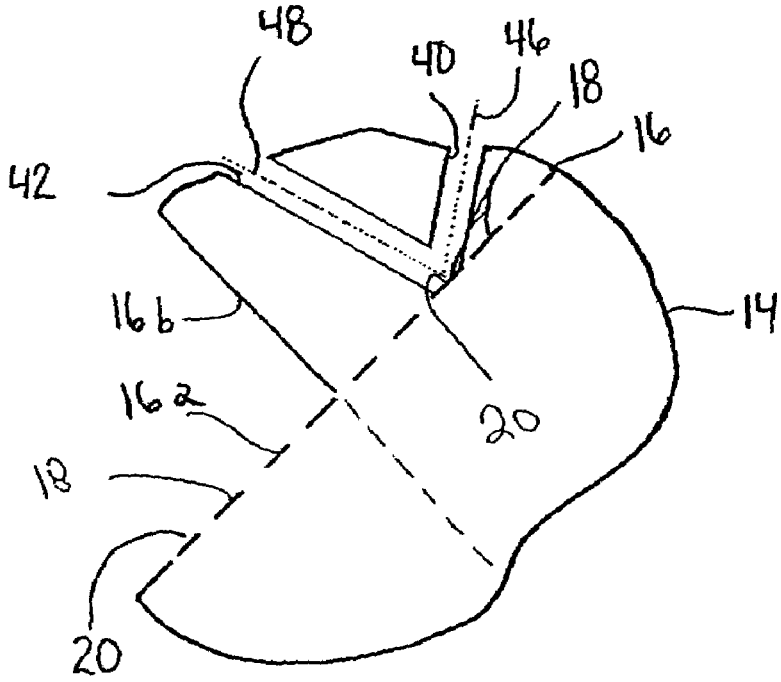
FIG. 21 is a side elevation view, in section, of a high reflectivity micro mirror constructed in accordance with the teachings of the present invention with crystalline plane only partially exposed.

Structure and Relationship of Parts:

Referring to FIG. 4*d*, there is provided a high reflectivity micro mirror 10 which includes a monolithic bulk crystal silicon 12 that has an anisotropic body 14 with a crystalline plane 16. Referring to FIG. 21, body 14 has a mirror surface 18 which is co-extensive with a selectively exposed portion 20 of crystalline plane 16.

Referring to FIGS. 4*a* through 4*d*, the preferred method of making high reflectivity micro mirror 10 involves providing monolithic bulk crystal silicon 12 that has anisotropic body 14 with crystalline plane 16. Chemical agents are then applied to selectively remove a portion of body 14 overlying crystalline plane 16 to expose portion 20 of crystalline plane 16, such that mirror surface 18 is formed that is co-extensive with exposed portion 20 of crystalline plane 16. High reflectivity micro mirror 10 can be in a number of configurations depending upon what portions 20 of crystalline plane 16 are selectively exposed. For example, crystalline plane 16 can be exposed to an extent that it becomes part of an exterior surface 22 of body 14 or crystalline plane 16 can be positioned internally within body 14, as will hereinafter be further described.

Figure 1B:
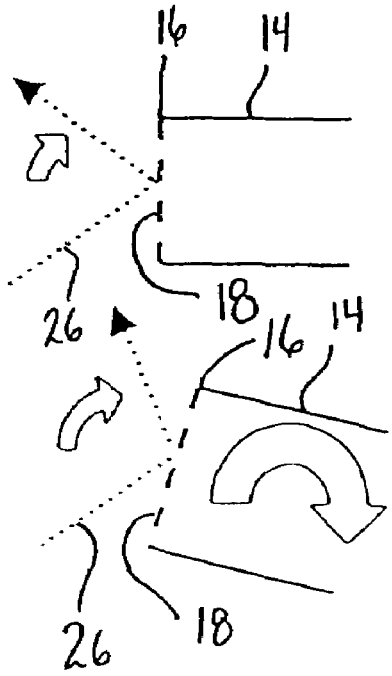
FIG. 1*b* is a side elevation view of a side elevation view of a high reflectivity micro mirror illustrated in FIG. 1, with rotational adjustment.
Figure 2A:
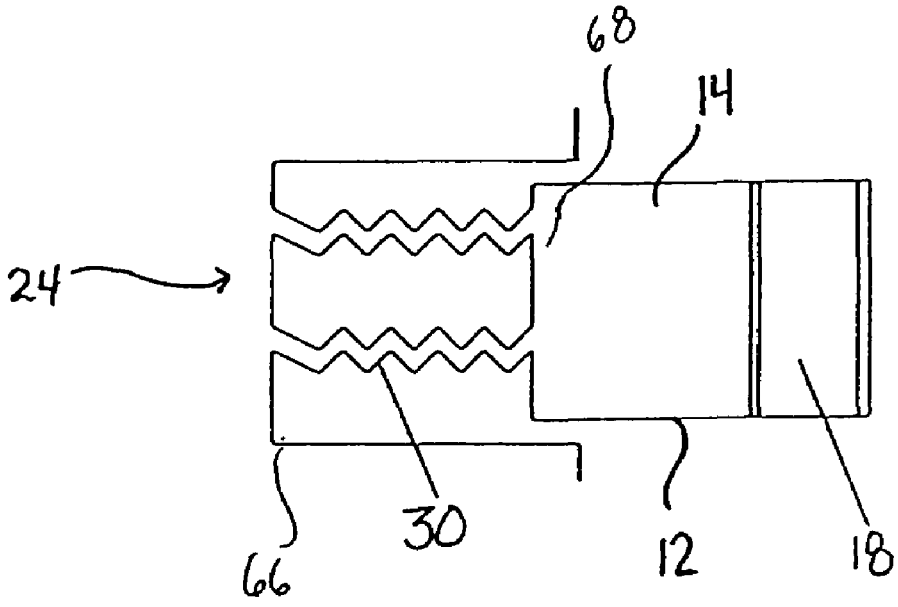
FIG. 2*a* is a top plan view of the high reflectivity micro mirror illustrated in FIG. 1, with actuator.
Figure 2B:
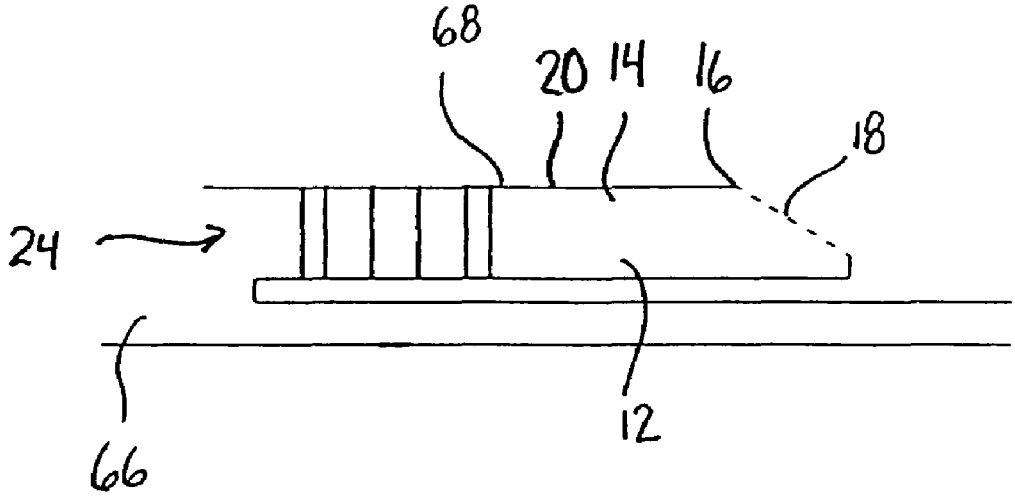
FIG. 2*b* is a side elevation view of the high reflectivity micro mirror illustrated in FIG. 2*a*.
Figure 14:
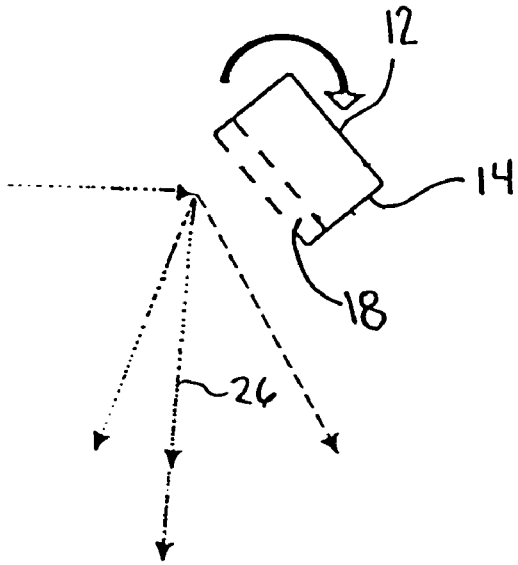
FIG. 14 is a top plan view, in section, showing the high reflectivity micro mirror illustrated in FIG. 1, with servo rotation.
Figure 19A:
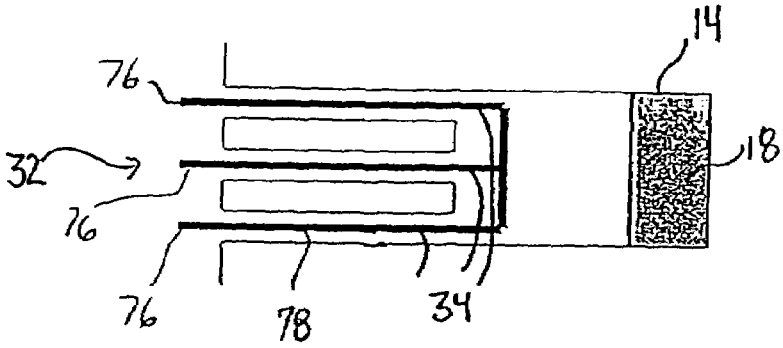
FIG. 19*a* is a top plan view, in section, showing the high reflectivity micro mirror illustrated in FIG. 1, with an expandable actuator in an expanded condition.
Figure 19B:
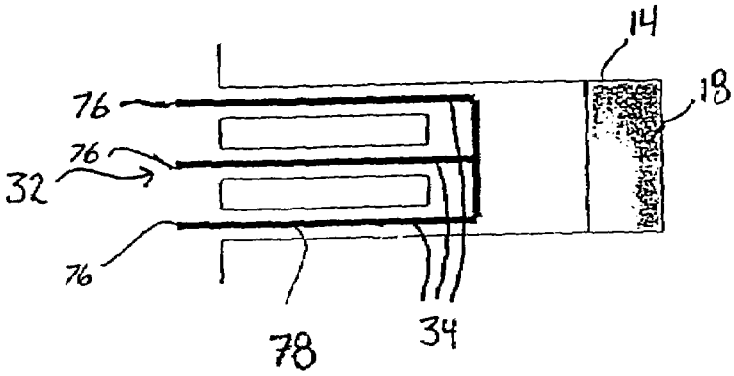
FIG. 19*b* is a top plan view, in section, of the high reflectivity micro mirror illustrated in FIG. 19*a*, with the expandable actuator in a contracted condition.
Figure 20:
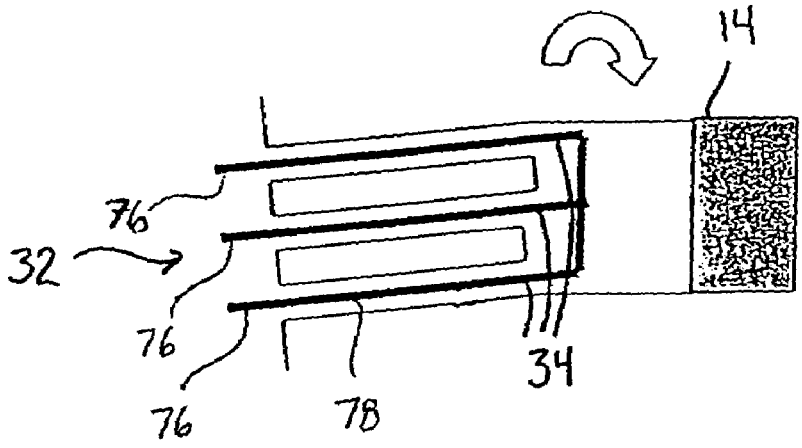
FIG. 20 is a top plan view, in section, of the high reflectivity micro mirror illustrated in FIG. 19*a*, with the expandable actuator rotating the body to adjust the angle of the mirror surface.

Referring to FIGS. 2*a* and 2*b*, there is illustrated an actuator, generally indicated by reference numeral 24. High reflectivity micro mirror 10 can be positioned through the use of actuator 24. Actuator 24 includes arms in the form of springs 30 that move in response to an application of an electrical current. In the illustrated embodiment, arms are shown as springs 30, however it will be appreciated that there are other structures that could operate as arms 30. Referring to FIG. 1*a*, there is illustrated how selective movement of body 14 axially can thereby shift the position of a beam 26 reflecting from mirror surface 18. Referring to FIG. 1*b*, and FIG. 14, there is illustrated how selective rotation of body 14 can thereby adjust the reflection angle of mirror surface 18. Referring to FIGS. 19*a* through 20, there is illustrated another form of actuator, generally indicated by reference numeral 32. Referring to FIGS. 19*a* and 19*b*, actuator 32 has arms that are resistors 34 which heat up and expand upon application of an electrical current. Referring to FIG. 20, three parallel arms 34 are provided. It can be seen how unequal expansion of arms 34 effects a partial rotation of body 14.

Figure 3:
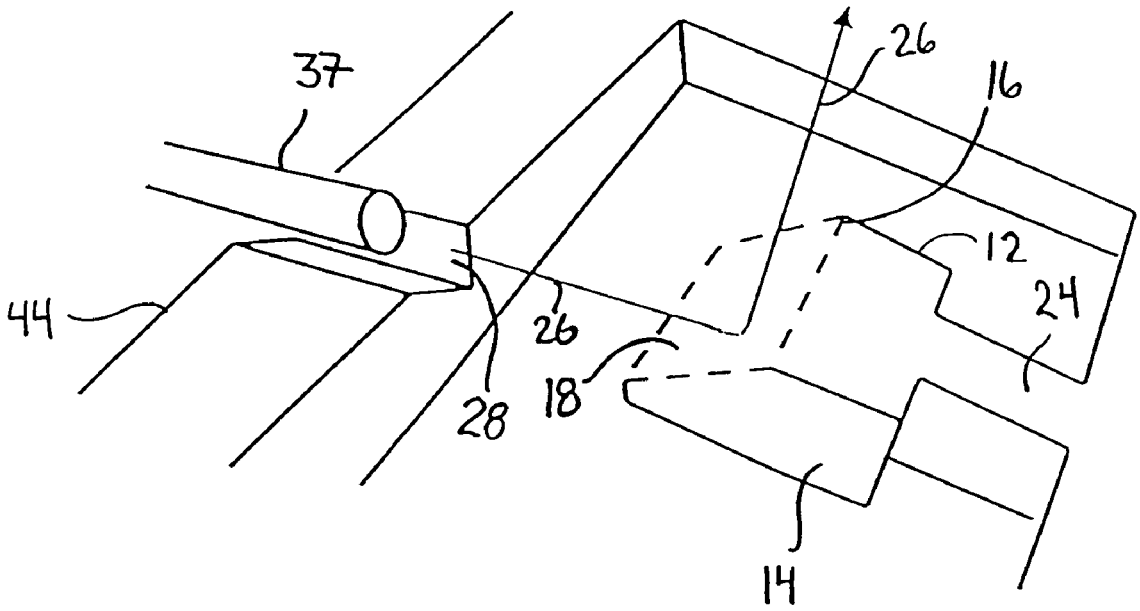
FIG. 3 is a perspective view of the high reflectivity micro mirror illustrated in FIG. 1, with a fixed mounting and fibre optic alignment passage.

Referring to FIG. 3, advantages can be obtained by using crystalline plane 16 of bulk crystal silicon 12 for purposes of alignment. In the illustrated embodiment, a passage 28 extends across crystalline plane 16. An optical fibre 37 which shown as the source for light beam 26 is aligned in passage 28. Once the basic teachings are understood, it will be appreciated that the passages can be arranged in a number of configurations. For example, passages 28 can be arranged as parallel passages or intersecting passages. Regardless of the orientation of the passages, in all cases their alignment will have atomic accuracy as they extend across crystalline plane 16.

As illustrated in FIG. 21, crystalline plane 16 does not have to be completely exposed, only that portion required as mirror surface 18 need be exposed. Further, crystalline plane 16 can remain positioned internally within body 14. Body 14 has an inlet passage 40 and an outlet passage 42 which intersect at a small selectively exposed portion 20 of crystalline plane 16. This small selectively exposed portion 20 serves as mirror surface 18. It is also possible to effect alignment by utilizing intersecting crystalline planes 16*a* and 16*b*.

Figure 5:
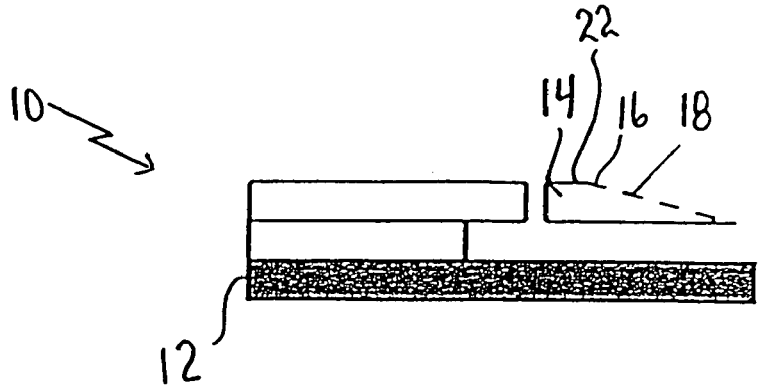
FIG. 5 is a side elevation view, in section, showing a fourth step in fabricating the high reflectivity micro mirror illustrated in FIG. 1, with the mirror surface having a differing orientation angle.
Figure 6:
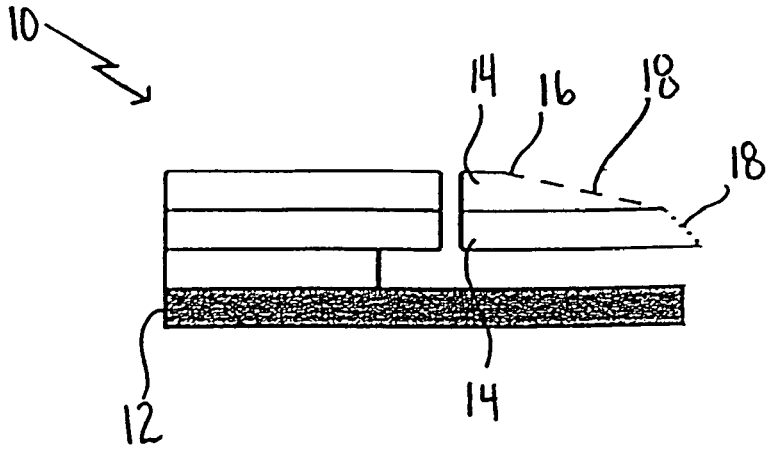
FIG. 6 is a side elevation view, in section, showing the high reflectivity micro mirrors illustrated in FIGS. 4*b* and 5, combined to form a composite mirror surface having two differing orientation angles.
Figure 7:
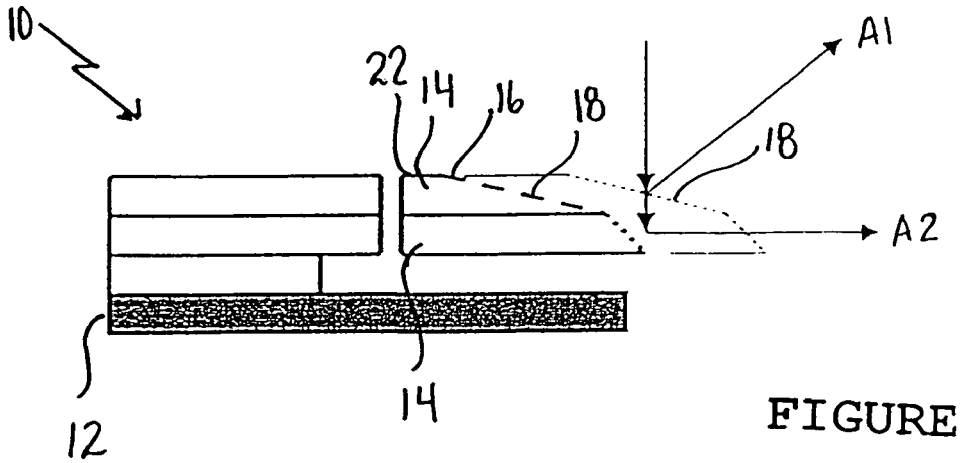
FIG. 7 is a side elevation view, in section, showing how the high reflectivity micro mirror illustrated in FIG. 6, can be used to direct a light beam in two differing reflection angles.

Referring to FIGS. 5 through 7, two or more bodies 14 can be stacked to provide composite mirror surface 18 made up of mirror surfaces of two or more bodies 14. This can be of benefit when mirror surface 18 of a larger size or unusual shape is required.

Figure 8:
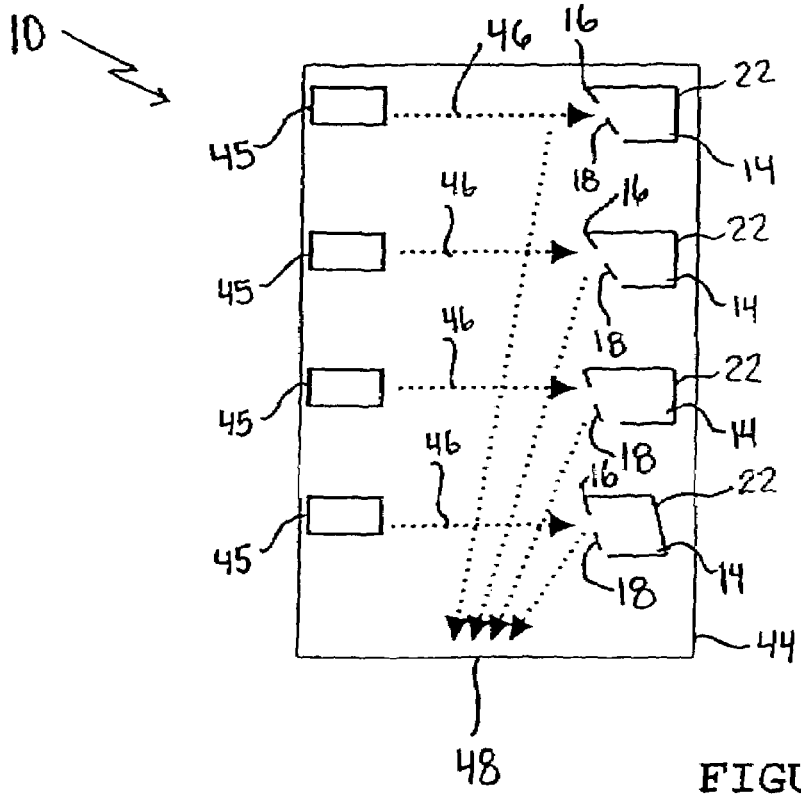
FIG. 8 is a top plan view, in section, showing the high reflectivity micro mirror illustrated in FIG. 1, incorporated in an apparatus that combines light beams.

Referring to FIG. 8, high reflectivity micro mirror 10 can be positioned in a housing 44 that has a plurality of ingress light paths 46 and a single egress light path 48. In the illustrated embodiment, lasers 45 are shown as being the light source. A plurality of monolithic bulk crystal silicon 12 is provided. Each bulk crystal silicon 12 has anisotropic body 14 with crystalline plane 16 and exterior surface 22. On each body 14, crystalline plane 16 is in a selected angular orientation and mirror surface 18 is co-extensive with of crystalline plane 16 on exterior surface 22 of body 14. One of bodies 14 is positioned on each ingress light path 46 and has mirror surface 18 oriented at reflection angle that is adapted to reflect light beam 26 to single egress light path 48. Bodies 14 can either be fixed, or can be equipped with actuators that are capable of rotating bodies 14, as illustrated in FIGS. 1*b*, 14 and 20.

Referring to FIGS. 9*a* through 10*b*, high reflectivity micro mirror 10 can be included in a housing 44 which has a plurality of ingress light paths 46 and a plurality of egress light paths 48. A plurality of monolithic bulk crystal silicon 12 are also provided. Each monolithic bulk crystal silicon 12 has anisotropic body 14 with crystalline plane 16 and exterior surface 22. Each crystalline plane 16 is in a selected angular orientation and has a mirror surface 18 that is co-extensive with exposed portion 20 of crystalline plane 16 on the exterior surface 22 of body 14. Each body 14 is positioned within housing 44 and out of alignment with ingress light path 46. Several actuators are provided for moving one of bodies 14 into one of ingress light paths 46 until mirror surface 18 is oriented at a reflection angle that is adapted to direct reflected beam 26 along a selected one of egress light paths 48. An examples of a suitable actuator is illustrated in FIGS. 19*a* and 19*b*.

Figure 11:
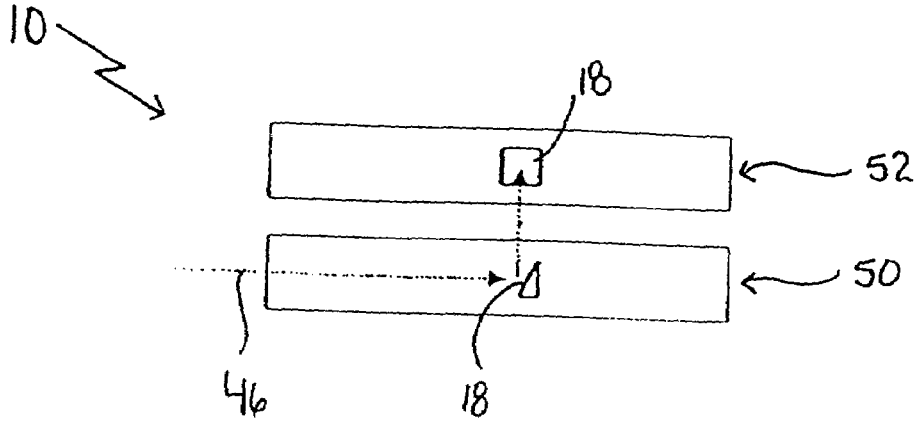
FIG. 11 is a side elevation view, in section, showing the high reflectivity micro mirror illustrated in FIG. 1, incorporated in an apparatus that switches light beams on two planes with two micro mirrors.
Figure 12:
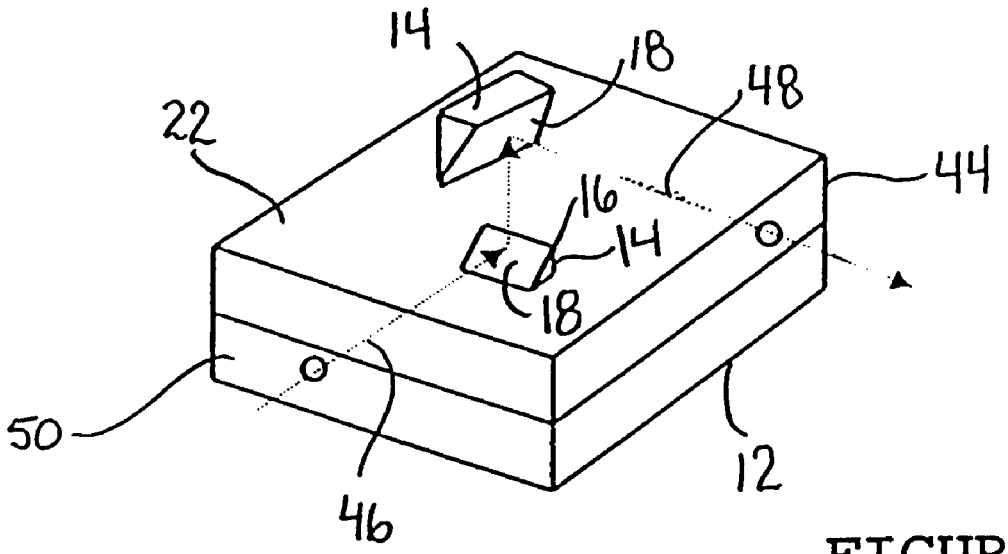
FIG. 12 is a perspective view of the switching apparatus illustrated in FIG. 11.
Figure 15:
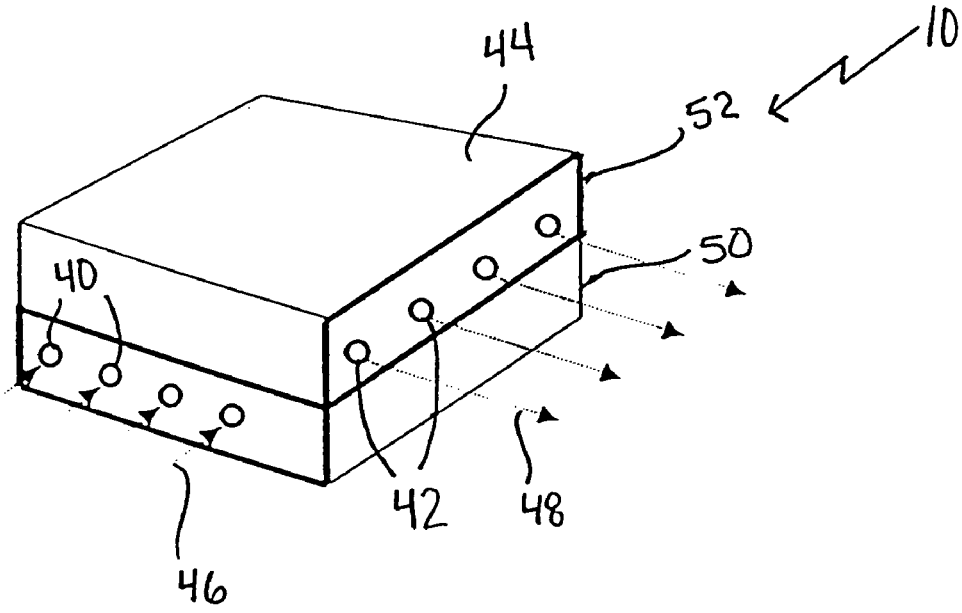
FIG. 15 is a perspective view of a switching apparatus similar to that illustrated in FIG. 11, only having multiple ingress light paths and multiple egress light paths.

Referring to FIGS. 11 and 12, high reflectivity micro mirror 10 is provided that includes housing 44 with one ingress light path 46 on a first plane 50 and one egress light path 48 on a second plane 52. Egress light path 48 is angularly offset from ingress light path 46. Two monolithic bulk crystal silicon 12 are provided with anisotropic bodies 14. Crystalline plane 16 of each body 14 is in a selected angular orientation and mirror surface 18 is co-extensive with exposed portion 20 of crystalline plane 16 on exterior surface 22 of body 14. One of bodies 14 is positioned on first plane 50 in ingress light path 46 with mirror surface 18 oriented at reflection angle that is adapted to reflect light beam 26 to second plane 52. The other body 14 is positioned on second plane 52 with mirror surface 18 oriented at a reflection angle that is adapted to direct reflected light beam 26 along egress light paths 48. Housing for high reflectivity micro mirror 10 can have more than one ingress light path 46 and one egress light path 48. Referring to FIG. 15, high reflectivity micro mirror 10 is provided that is similar to that illustrated in FIGS. 11 and 12 but which includes housing 44 that has a plurality of inlet passages 40 for a plurality of ingress light paths 46 on first plane 50 along with a plurality of outlet passages 42 for a plurality of egress light paths 48 on second plane 52.

Figure 16:
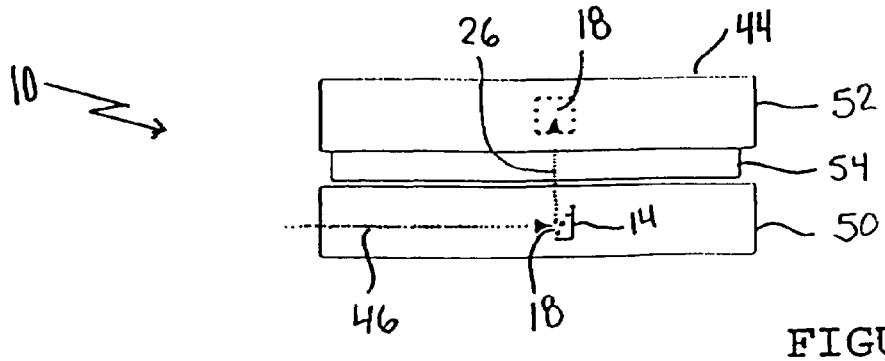
FIG. 16 is a side elevation view, in section, of a switching apparatus similar to that illustrated in FIG. 15, only having a membrane disposed between the first plane and the second plane to alter properties of the light beams as they pass from the ingress light paths to the egress light paths.
Figure 17:
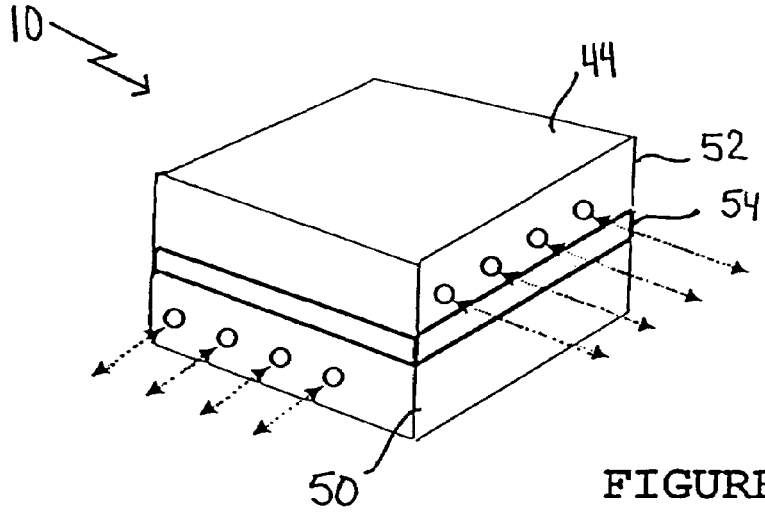
FIG. 17 is a perspective view of the switching apparatus illustrated in FIG. 16.

Referring to FIGS. 16 and 17, high reflectivity micro mirror 10 is illustrated which is similar to that illustrated in FIGS. 12 and 15. However, it is configured so as to include a light penetrable membrane 54 that is placed between first plane 50 and second plane 52, thereby altering properties of light beam 26 passing from ingress light path 46 to egress light path 48. Light penetrable membrane 54 can be a light filter or can be adapted to effect light beam modulation.

Figure 13:
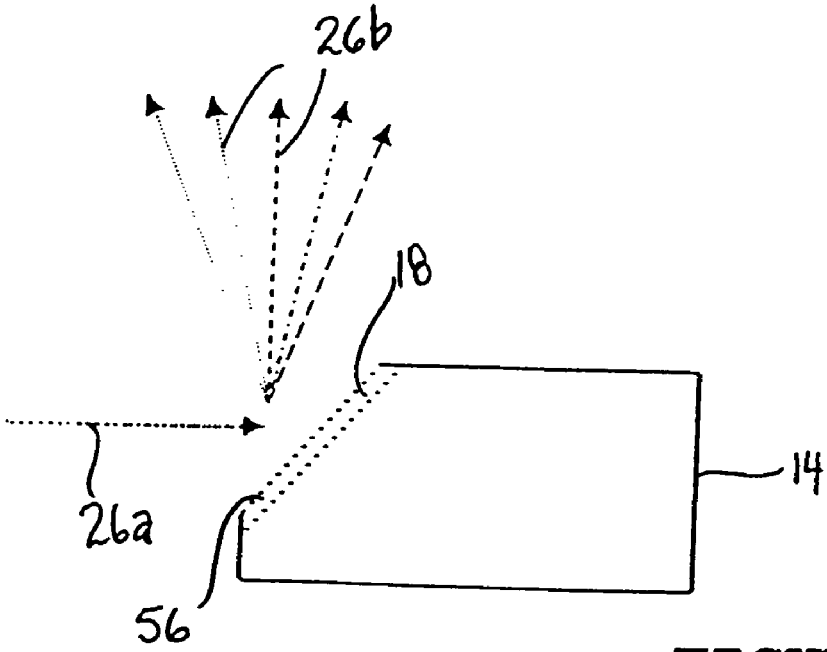
FIG. 13 is a side elevation view, in section, showing the high reflectivity micro mirror illustrated in FIG. 1, with a beam splitting surface.

Referring to FIG. 13, mirror surface 18 is provided that has a beam splitting surface treatment whereby a refractive surface 56 is adapted to split an input light beam 26*a* into several output light beams 26*b*. In the illustrated embodiment, refractive surface 56 is depicted however it will be appreciated that a diffractive surface and holographic surface are also adapted to split an input light beam 26*a* into several output light beams 26*b*.

Figure 18A:
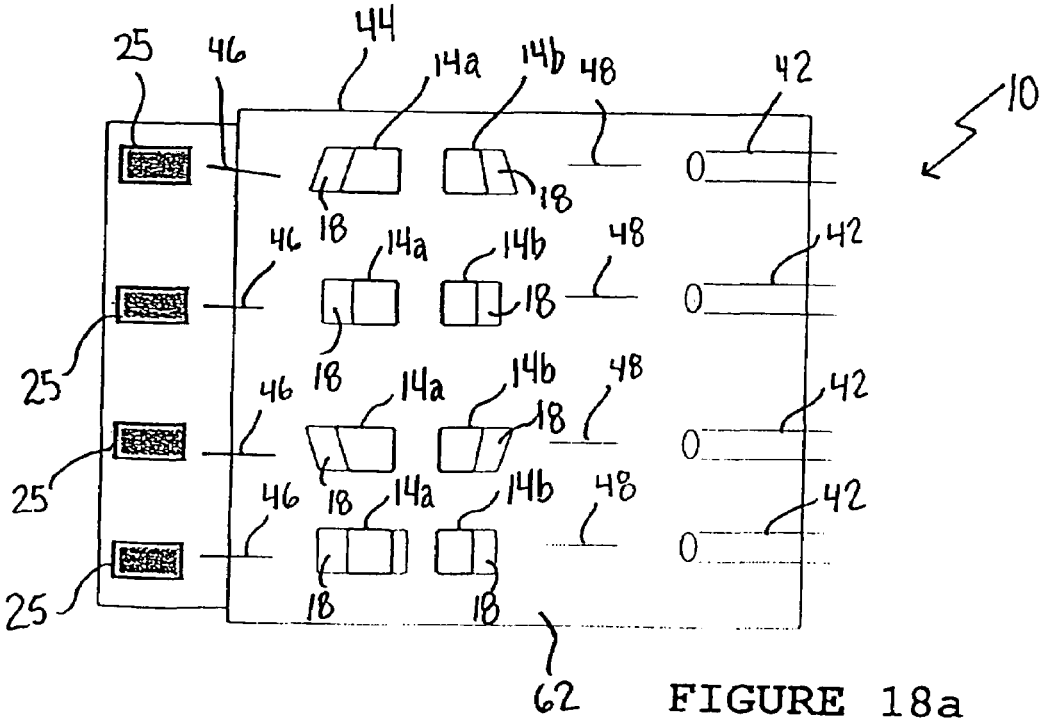
FIG. 18*a* is a top plan view, in section, showing the high reflectivity micro mirror illustrated in FIG. 1, incorporated in an apparatus for aligning light beams.
Figure 18B:
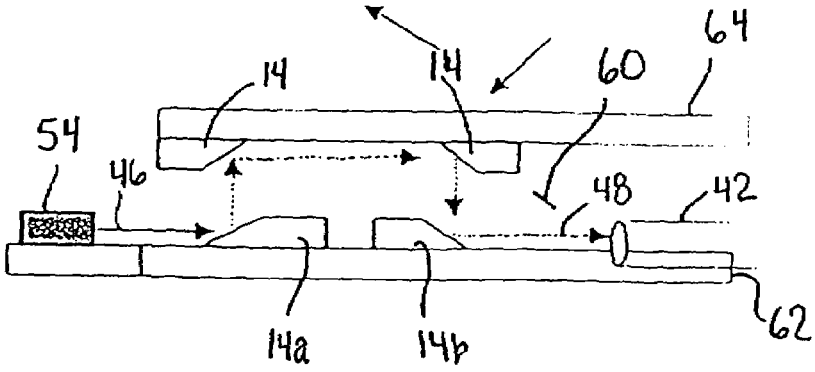
FIG. 18*b* is a side elevation view, in section, of the apparatus for aligning light beams illustrated in FIG. 18*a*.

Referring to FIGS. 18*a* and 18*b*, there is provided high reflectivity micro mirror 10 which includes housing 44 that has ingress light paths 46 and corresponding egress light paths 48. Laser 25 is shown as being the source of light beam 26. Each ingress light path 46 is on a common plane 58 but out of axial alignment with corresponding egress light path 48. Housing 44 has an interior cavity 60, a first supporting surface 62 and a second supporting surface 64 in parallel spaced relation. Monolithic bulk crystal silicon 12 has anisotropic body 14 with crystalline plane 16 and an exterior surface 22. Crystalline plane 16 is in a selected angular orientation and mirror surface 18 is co-extensive with exposed portion 20 of crystalline plane 16 on exterior surface 22 of body 14. A first body 14*a* is positioned on first supporting surface 62 in ingress light path 46 with mirror surface 18 oriented at a reflection angle that is adapted to reflect light beam 26 to second supporting surface 64. A pair of angularly offset bodies 14 are positioned on second supporting surface 64 with their mirror surfaces 18 oriented at reflection angles that are adapted to effect a realignment of light beam 26 and reflect light beam 26 back to first supporting surface 62. A second body 14*b* is positioned on first supporting surface 62 with mirror surface 18 oriented at a reflection angle that is adapted to reflect light beam 26 along corresponding egress light path 48.

Summary of the Basic Ideas:

1) Single Crystal Bulk Silicon etching used to achieve mirror surface for use in light beam deflection and switching. Single Crystal Bulk Silicon used with mirror surface on moveable element is etched from same bulk silicon as mirror surface.

2) Single Crystal Silicon that is anisotropically etched along crystal planes to provide precision alignment of separate elements. An example is v-groove for fiber access that is aligned to crystal mirror along another crystal plane. Alignment is possible to atomic accuracy with respect to angle.
3) Wavelength splitting element (diffractive, holographic, reflective etc.) is applied to mirror surface to allow for wavelength division demultiplexing on mirror element. The same element can be used to switch beam, beam deflect at controllable angle and demultiplex wavelength of incoming beam. Wavelength splitter, demultiplexer. Can be used for WDM (Wavelength Division Multiplex) fiber optic signals or DWDM (Dense WDM).
4) Free space Wavelength combiner multiplexer based on several mirror surface elements
5) Monolithic switch based on incoming signals switched to outgoing paths with using two mirror elements to provide full in out switch selection.
6) Monolithic switch with frequency selective element to provide switching and frequency selection in single unit.
7) Intensity or power level control is possible by fine alignment control of actuator. This can allow beam power or signal maximization or signal level compensation or equalization across switch or frequencies which is very useful for WDM.
8) Multiple control elements can be operated at the same time in a parallel fashion.
9) The use of servo elements allows laser diode elements to be placed with imperfect alignment. Individual laser diodes do not have to be servo, only their output beam. This allows the laser diodes to be placed closer together on better heat sinking material.
10) Monolithic beam aligner correction servo for multi laser application.

1.0 Introduction

Single crystal silicon referred to above could be quartz sapphire or some other crystalline material. This can be any material that is anisotropically etchable. Typically single crystal materials have this attribute. There is a need for steerable micro-mirrors with high reflectivity. These mirrors could be of use in optical Telecom systems, optical scanners, scientific instrumentation, and other applications. In more detail, these mirrors can be used as: 1) scanners: scanning an optical beam in a desired pattern, 2) servos: allowing the position of the an optical light beam to be actively adjusted to maintain optimal positioning on a target (such as an optical fiber or a detector), and 3) switches: allowing optical beams to be switched from one position to another in, for example, an optical switching system used in Telecom.

For many of the above applications, a small device (order of 1 to 100's of microns) and small amounts of power needed for motion are important parameters in developing a practical device. These conditions are satisfied by devices fabricated using the techniques known as silicon micromachining and Micro-electro-mechanical Systems (MEMS). For certain applications, such as Telecom and scientific measurements, there is also a strong desire to have a mirror that causes as small a power loss and minimum beam distortion as possible. For these two criteria to be met, an optically smooth, high reflectivity surface is needed. This has proven difficult to develop using the MEMS processing techniques that are typically used to fabricate steerable micro-mirrors. Herein is described a steerable micro mirror based on a mirror tilted at an angle that is integrated with an actuator that moves the mirror. The basic principle of operation is shown in FIGS. 1*a* and 1*b*. The device consists of two types of fabrication processes are described below; the first is based on bulk silicon micromachining technology, and the second uses the concepts described in the first implementation, but is a more general technique. Both of these techniques allow for the devices to be fabricated using standard microfabrication techniques, which then allows for mass production of steerable high reflectivity micro-mirrors.

2.1 General Description

The device consists of two portions: the actuator and mirror (FIGS. 2*a*, 2*b*, and 3). Using a mirror, which is tilted with respect to the axes of motion of the actuator, gives the device the ability to steer the beam. The actuator can be any MEMS actuator, which produces motion when a voltage or current is applied to the device. Possible actuators are comb drives or resistively heated springs. The motion of the actuator can be simply linear, which causes a linear displacement of the optical beam or it can move the two edges of the mirror differentially, which will allow the optical beam to be deflected in any direction.

The central idea of this process is that the tilt of the mirror is created during the fabrication process. In the simplest implementation, the mirror surface is formed by the crystalline planes of silicon. The general outline of the fabrication process is shown in FIGS. 4*a* through 4*d*. The process begins with a substrate that contains three layers. The first layer which is the device layer, is the one that the actuator and the mirror are fabricated from. This layer can be silicon or any other material that an actuator and a bevelled mirror can be fabricated in. The middle layer is a sacrificial layer, that is a layer that is removed the free the structures formed in the top layer. This layer can be formed from any material that can be selectively etched compared to the device layer is compatible with all the processes needed to fabricate the device. The last layer is the substrate. This layer can be any material that gives the device strength to be handled during processing. This can be any material that is compatible with the processing of the sacrificial and device layers. In some implementations, there could be only a single layer; the device layer. The other layers are needed in the other implementation to support the device during processing. If the device layer is thick enough, the requirement for the sacrificial layer and substrate can be removed.

2.2 Fabrication Process:

In the simplest implementation, the substrate and the device layers are made from silicon. The sacrificial layer can be fabricated from silicon dioxide, doped silicon dioxide, silicon nitride, doped or undoped silicon. A possible structure for the wafers would be a 30 micron thick device layer, on a 1 micron thick silicon dioxide sacrificial layer, and a 500 micron thick silicon wafer. These wafers can be purchased commercially. They are called SOS (silicon/oxide/silicon) or SOI (silicon on insulator) wafers.

The process flow is:

1) The actuator is patterned into the device layer using standard lithography and deep reactive ion etching.
2) The electrical connections can be made to the actuators are made at this point or later in the process using standard metal deposition and lithography techniques.
3) The mirror surface is fabricated by:
   a) covering the actuator and the electrical contacts with a material that covers all the exposed silicon and electrical contacts and will not be removed by the an isotropic silicon etch. Silicon nitride deposited by plasma enhanced chemical vapor deposition (PECVD) is one such material.

b) openings in the above masking layer, which are for the fabrication of the mirrors, are made using standard lithographic and etching techniques.

c) the mirrors are etched using aqueous an isotropic silicon etching techniques. The bevelled mirror is formed by the slower etch rate of the crystalline planes of the silicon that forms the device layer.

d) the masking layer is removed using standard etching techniques

4) The actuator and the mirror are 'freed' from the substrate by etching the sacrificial layer. This etching is performed using standard etching techniques. For example, for a silicon dioxide layer, HF or buffered HF acid solution could be used.

5) If the surfaces of the mirrors do not have sufficiently high reflectivity, a layer of a high reflectivity material can be deposited onto that surface. An example of this is to deposit a thin layer of aluminum onto the surface of the mirror.

An Optically Smooth surface can be formed using aqueous silicon an isotropic etching techniques if;

a) the device layer is formed from silicon wafers with a minimum of defects.

b) processing the wafers does not add significant numbers of defects.

c) the masks are accurately aligned to the crystal directions.

d) the chemistry of the aqueous silicon etch solutions is modified to create smooth surfaces.

e) proper etching techniques are used to ensure smooth surfaces.

2.3 Variation 1: Achieving Different Tilt Angles

If a silicon wafer is used as the device layer, the mirror will be bevelled at an angle of 54.7 degrees. Other angles can be achieved by using silicon wafers that are cut at different angles to the direction as the device layer. These 'off-cut' wafers are bonded to the sacrificial layer and the substrate as needed. The surface of the mirrors will continue to be the planes, but the angle between bevelled mirror surface and the device surface can be arbitrarily chosen as illustrated in FIG. 5). This may be used as a on/off switch or as a deflection from channel 1 output to channel two.

2.4 Variation 2: Achieving Two or More Distinct Angles on a Single Mirror

In switching applications, a mirror that has two or more distinct angles would be of great use. This can be achieved by bonding two or more wafers, each of which is cut at a different angle to the direction are used to form the device layer. A mirror surface with a two angle structure is shown in FIG. 6. With the actuator in one position, the optical beam reflects off one surface. If the actuator shifts position sufficiently, the optical beam will reflect off the second angular surface. Now the beam is directed in a significantly different direction.

3.0 A General Technique for Forming the Bevelled Mirror

The mirror surface can be formed using other techniques. One such technique is to use polishing to from the bevel. Prior to the fabrication of the actuator, the portion of the device that will become the mirror surface is ground and polished to the desired angle and surface finish. The actuator and other portions of the device are formed using mostly standard lithographic techniques, with a modified photo resist spinning process. The advantage of this technique is that the surface finish on the mirror is not dependent on aqueous anisotropic etching, but rather polishing. This increases the possible materials the devices can be fabricated from.

4.0 Resistive capacitive or inductive elements applied to or built into the actuator can be used to achieve motion and servo or mechanical fine control over beam deflection. This can utilize piezio electric effects of the actuator or capacitive electrostatic electrodynamic or magnetic forces can be used to deflect actuator in various ways. This motion can be used to provide:

1) On off beam switching motion to interact in a major way with light beams.

2) Power control of output by reducing coupling by increasing miss alignment. Fine control over power levels by small deflections.

3) Frequency or wavelength selectivity for multiplexing or demultiplexing WDM signals.

5.0 Control over actuator position by mechanical motion may be used for translation motion, tilt or beam angle deflection, servo or fine control. Each of these is used to interact with the light beam to rotate or translate the beam vector.

6.0 The surface optical coating on actuator mirror surface can be used to provide optical frequency or wavelength splitting for selective switching of individual signals. Incoming beam is WDM and contains many frequency bands or channels. Output beam is split by diffractive or holographic surface on switching element into individual beams. Then a single beam out of the family of beams may be selected and directed to an output channel.

Advantages over surface micromachining the traditional way of building micro mirrors and actuators:

1) low number of fabrication steps compared to surface micromachining.

2) low cost fabrication equipment required compared to surface micromachining.

3) monolithic elements not subject to stresses and deflections of surface micromachining. No dishing curling warping delaminating which is common in surface micromachining.

4) single monolith element is used so multiple copies can be produced at same time One set of tooling provides multiple devices.

5) self aligning by use of crystal planes of single crystal silicon.

6) monolithic so assembly not required.

7) simple surface treatment either pre or post process can be used to create elements or other features such as diffractive optical surface on switch element.

8) because multiple units are fabricated monolithically each will have atomic level alignment for primary angles.

9) integration of v-groove channels for fiber optic alignment.

Additional comments regarding FIGS. 1*a* through 21:

FIG. 1*a* shows a translation of mirror surface top original position and translation of mirror showing beam position shift. FIG. 1*b* showing beam angle deflection change. Top shows original beam angle deflection bottom shows mirror angle change giving rise to beam angle deflection change. FIGS. 2*a* and 2*b* are showing substrate 66, actuator base 68, actuator element 24 along with mirror surface 18. FIG. 3 illustrates optic fiber 37 alignment and mirror 18 as well as showing beam path 26. V-groove 28 for optical fiber 37 alignment along with monolithic mirror 18. Being single crystal monolithic 12 angles of V-groove 28 are tightly controlled. FIGS. 4*a* through 4*d*, involve the fabrication process.

1. Starting with device layer 70, sacrificial layer 72 and substrate 66.
2. Fabricate Actuator Base 68
3. Fabricate Mirror 18
4. Free Device 74
5. Not shown is Actuator fabrication which anchors mirror 18 and actuator base 68 to rest of device 70.

FIG. 5 is showing the fabrication of single mirrored surface 18 on crystalline plane 16. FIG. 6 is showing fabrication using silicon etched along two different crystalline planes 16 of two wafer bodies 14, at different angles. FIG. 7 is showing actuator 24 in two positions with differing bevel angles causing two differing exit angles of incoming beam 26. Translation turns into beam angle rotation. FIG. 8 is showing several beams 46 being combined by angled reflection off separately controlled mirrors 18 used to produce a combiner multiplexer device. Space based switch/servo elements used to create space based combiner for WDM. Note that lasers 45 can be roughly aligned where as the mirror actuators 24 provide final adjustment. DEMA stands for Deflector Element Mirror plus Actuator. Laser 45 can be of differing wavelengths or alternatively lasers 45 can be same wavelengths but different data channels and the DEMA elements could be used as on/off switching elements. Alternatively lasers 45 could be the same wavelength and in the combiner could used for increased power by the use of multiple lasers 45 for one output beam 48.

Figure 9A:
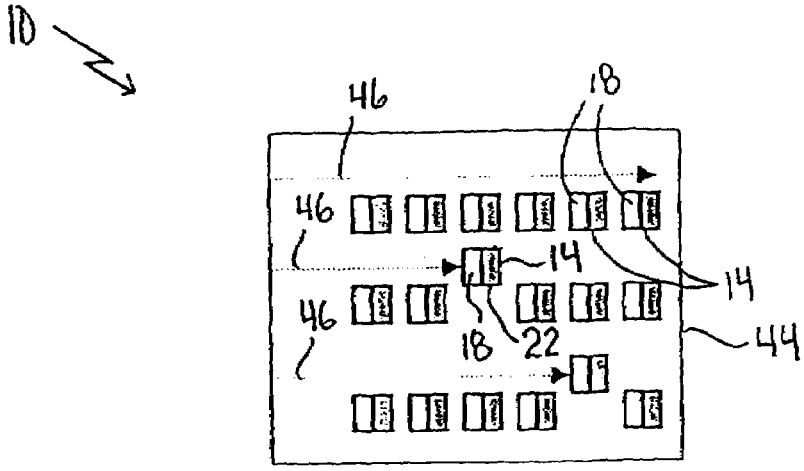
FIG. 9*a* is a top plan view, in section, showing the high reflectivity micro mirror illustrated in FIG. 1, incorporated in an apparatus that switches light beams with a single micro mirror.
Figure 9B:
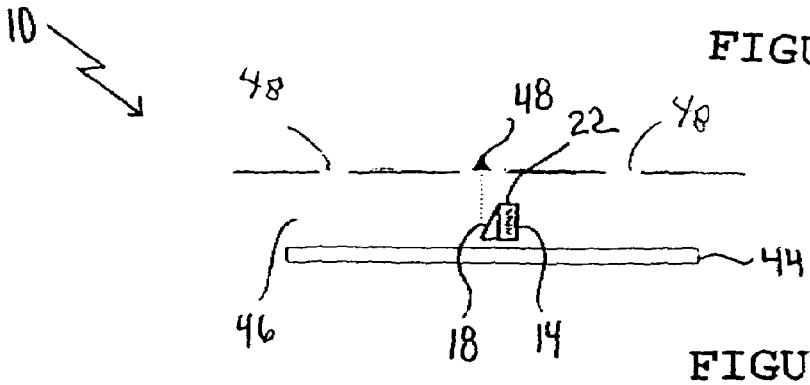
FIG. 9*b* is a side elevation view, in section, showing the switching apparatus illustrated in FIG. 9*a*.
Figure 10A:
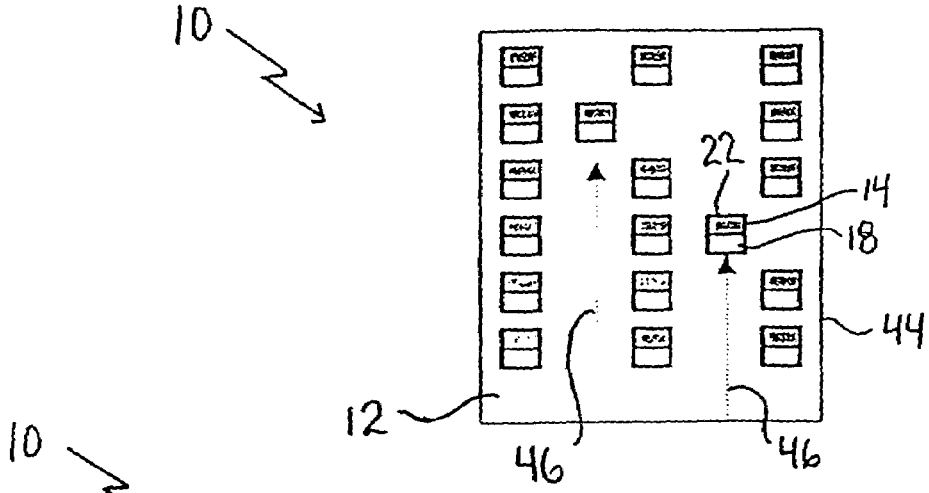
FIG. 10*a* is a bottom plan view, in section, showing the switching apparatus illustrated in FIG. 9*a*.
Figure 10B:
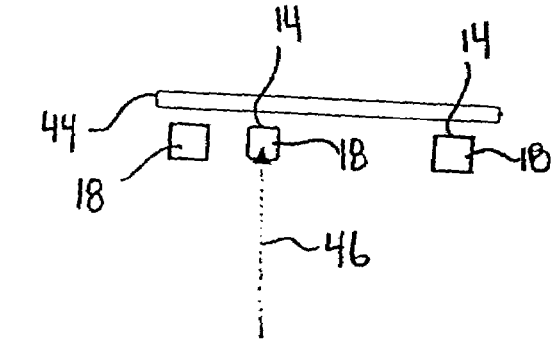
FIG. 10*b* is a top plan view showing the switching apparatus illustrated in FIG. 9*a*.

FIGS. 9*a* and 9*b* is showing part of cross point switch and is showing DEMA moving into beam path 46 and deflecting beam 46 with 3 beam rows 46 and 6 switching column elements 16. Multiple input beams 46 are shown with DEMA elements acting as switches to interrupt and deflect beams 46. FIGS. 10*a* and 10*b* are illustrating a switch showing path of light 46. FIG. 11 shows a combined switch using two monolithic elements 14. FIG. 12 is showing two switching elements 14 of cross point switch. FIG. 13 is showing WDM demultiplex wavelengths using surface optical coating on mirror 18. Surface treatment provides selective direction of split beam 26 as well as direction through DEMA deflective element 14. Surface 56 may be holographic or other grating or diffractive surface. Single multifrequency input single frequency output. FIG. 14 shows servo rotation to select frequency of WDM or DWDM wavelength, servo angle back and forth to align selected frequency/wavelength to output port. In this way switch demultiplex and selected attenuation is formed. FIG. 15 shows full access cross point switch. Input channels 46 can be switched to any output channel 48 by the use of two switching elements. Note that with channel splitting (WDM selection) surfaces on channel can be diverted to any output channel 42. Two monolithic parts 50,52 make input channels 46 and output channels 48 switch. FIG. 16 shows full access cross point switch. Input channels 46 can be switched to any output channel 48 by the use of two switching elements 14. Additional active or passive elements can be placed in vertical light path to allow for faster switching or light filtering or modulation of signals. The middle layer 54 is placed between the two monolithic layers 50, 52. FIG. 17 shows full crosspoint switch with active element. Note that the direction of light waves does not matter in cross point switch. Each channel can be input 46 or output 48. FIGS. 18*a* and 18*b* shows the use of laser diode beam corrector using two layer actuator system. Each laser diode beam 46 is placed as best alignment as possible on substrate for cooling substrate is switch and actuator. Laser beams 46, because of manufacturing and assembly variations, are not parallel beams. FIGS. 19*a* and 19*b* show the actuator construction to achieve translation and rotation in simple construction. Voltage 76 and heating element 78 are also shown. Active elements can be resistors which when current is applied heat up causing expansion. This expansion causes increase in length of the element attached. With three arm elements 34, rotation and translation can be achieved. If current is applied evenly on all three arms 34 or a balance between the two outer ones and the inner one then translation will be in a linear direction. If there is unbalanced currents in the arms 34 then rotation will occur because of uneven heating which leads to uneven expansion. Several alternative methods could be used including piezio resistive elements or electrostatic attraction actuators or magnetic actuators. FIG. 20 is showing rotation of mirror 18 due to unequal current on actuator arms 34. FIG. 21 illustrates the exposed portion 20 of body 14.

Using a bulk single crystal mirror surface allows further treatment of the surface to create superior mirror structures. This gives a stable mirror platform because of stable and controlled thickness of the base single crystal silicon. In contrast, other methods used to create mirrors such as polysilicon or thin film surfaces are not maintained flat under high temperatures or subsequent mechanical or chemical manufacturing steps. Specifically, high efficiency mirrors are made from very flat surfaces and are further processed by the addition of reflecting surfaces such as aluminum or gold or even dielectric layers. A bulk atomically flat surface of a bulk single crystal allows metal, dielectric or other mirror materials to be added without distorting the underlying flat surface. Further processing by the addition of any passive or active surface to the base mirror plane is much easier on a bulk material than on extant thin film material mirrors.

Photonic crystals are a new class of material which are being developed now. If photonic crystals are added to the bulk single crystal mirror structure, this will create a powerful new class of devices. For example, it can create a mirror with specific optical attributes, such as filtering and switching at the same time. Photonic crystals, by their nature, are unlikely to be produced on thin mirrors. A bulk single crystal mirror structure will assist in facilitating mirror surfaces treated with photonic crystals.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. An assembly for a movable optical element, the assembly comprising:

a body of monolithic bulk silicon having at least one passage defining a light path;

a support integrally formed out of the monolithic bulk silicon as part of the body;

an optical element supported by the support; and an actuator integrally formed out of the monolithic bulk silicon as part of the body and adapted to selectively cause linear movement of the support to move the optical element alternately into and out of the light path.

2. The assembly as defined in claim 1, wherein the optical element is a mirror.

3. The assembly as defined in claim 2, wherein the body has a crystalline plane in a selected angular orientation, the mirror having a mirror surface, which is co-extensive with an exposed portion of the crystalline plane.

4. The assembly as defined in claim 1, wherein the optical element is a light filter.

5. The assembly as defined in claim 1, wherein there is more than one optical element, each optical element being supported by a discrete integrally formed support with a dedicated actuator.

6. The assembly as defined in claim 2, wherein there is more than one mirror and more than one egress light paths, each mirror being supported by a discrete integrally formed support with a dedicated actuator, light being diverted along a different one of the more than one egress light paths, depending upon which mirror is moved into the ingress light path.

7. The assembly as defined in claim 1, wherein the body is a wafer.

8. The assembly as defined in claim 2, wherein the mirror has a refractive surface adapted to split an input light beam into several output light beams.

9. The assembly as defined in claim 2, wherein the mirror has a diffractive surface adapted to split an input light beam into several output light beams.

10. The assembly as defined in claim 2, wherein the mirror surface has a holographic surface adapted to split an input light beam into several output light beams.

11. The assembly as defined in claim 1, wherein the support moves in response to application of an electrical current.

12. The assembly as defined in claim 11, wherein the support has associated resistors which heat up and expand upon application of an electrical current.

13. The assembly as defined in claim 1, wherein the body has an ingress light path and an egress light path, with the optical element being moved into and out of the ingress light path, the optical element being a first mirror, the ingress light path defining a first plane; and a second body is provided having an ingress light path and an egress light path, with the optical element being moved into and out of the ingress light path, the optical element being a second mirror, the egress light path of the second body defining a second plane substantially parallel to the first plane, the egress light path of the body being axially aligned with the ingress light path of the second body, such that light entering the body along the first plane defined by the ingress light path is reflected by the first mirror to the second mirror and then reflected by the second mirror to the egress light path of the second body exiting on the second plane.

14. The assembly as defined in claim 13, wherein a light penetrable membrane is used to alter properties of light as it passes from the ingress light path of the body to the egress light path of the second body.

15. The assembly as defined in claim 14, wherein the light penetrable membrane is a light filter.

16. The assembly as defined in claim 14, wherein the light penetrable membrane is adapted to effect light beam modulation.

17. The assembly as defined in claim 13, wherein at least one of the first mirror or the second mirror has a reflectivity enhancing coating.

18. An movable optical element assembly comprising:

a monolithic bulk silicon body having at least one light passage path;

a support formed integrally with the monolithic bulk silicon body;

an optical element supported by the support; and an actuator formed integrally with the monolithic bulk silicon body and for selectively causing linear movement of the support so as to move the optical element alternately into and out of the light passage path.

* * * * *